US006729848B1

(12) United States Patent
Hasslen, III

(10) Patent No.: US 6,729,848 B1
(45) Date of Patent: May 4, 2004

(54) SENSOR MOUNT FOR SUMP DRAINING APPARATUS

(76) Inventor: John S. Hasslen, III, 1033 Manor Pl., Elk River, MN (US) 55330

( * ) Notice: Subject to any disclaimer, the term of this patent is extended or adjusted under 35 U.S.C. 154(b) by 0 days.

(21) Appl. No.: 10/317,274

(22) Filed: Dec. 12, 2002

(51) Int. Cl.[7] ..... F04B 49/06; F04B 49/00; F04B 17/00; G01M 19/00

(52) U.S. Cl. ..... 417/44.2; 417/36; 417/38; 417/423.3; 417/423.15; 73/168

(58) Field of Search ..... 417/36, 38, 44.2, 417/357, 414, 423.3, 423.15, 424.1, 360; 73/168, 299

(56) References Cited

U.S. PATENT DOCUMENTS 2,910,524 A * 10/1959 Schaffhauser ..... 174/15.6
3,093,083 A * 6/1963 Nielsen ..... 417/38
4,367,652 A 1/1983 Venuso
4,709,723 A * 12/1987 Sidaway et al. ..... 137/584
4,942,764 A 7/1990 Dews et al.
4,966,534 A 10/1990 Hasslen, III
4,992,030 A 2/1991 Hasslen, III
RE33,690 E 9/1991 Adams, Jr. et al.
5,156,047 A 10/1992 Tuma et al.
5,319,979 A * 6/1994 Abrahamson ..... 73/745
5,439,180 A * 8/1995 Baughman et al. ..... 241/36
5,627,523 A 5/1997 Besprozvanny et al.
5,793,294 A 8/1998 Schepka
5,816,510 A * 10/1998 Earle et al. ..... 241/46.01
5,962,795 A 10/1999 Lambert
6,174,142 B1 * 1/2001 Holt ..... 417/363
6,250,167 B1 6/2001 Peace et al.

* cited by examiner

*Primary Examiner*—Justine R. Yu
*Assistant Examiner*—Timothy P. Solak
(74) *Attorney, Agent, or Firm*—Haugen Law Firm PLLP

(57) ABSTRACT

A sump draining apparatus having an pressure transducer engaged in a receptacle that is in turn engaged in an open-ended collar of a housing. The receptacle and thus the pressure transducer is slideable in the axial direction into and out of the open-ended collar. The housing is generally cylindrical and contains a pump and motor, each of which has a generally cylindrical shape and is axially stacked in the housing. A cord having a vent and electrical leads for the pressure transducer is releasably engaged via a cord restraint at one end portion of the housing and the pressure transducer is releasably engaged in the receptacle in the open-ended collar at the other end of the housing. The receptacle and sensor may be removed, serviced, and/or replaced without the housing being opened and without the pump and motor being removed.

15 Claims, 5 Drawing Sheets

56
62
52
54
50
26
28
98
41
24
26
96
92
10
94
90

38
60
56
46
44
40
42

60
56
52
48
46
20

26
28
100
20
113
108
104
102
111
12
106
110
92
102
38
90
30
22
82
38
10
14
16
75
74

120
28
118
20
12
92
10
90
38
22
16
14
80
175
36
122
74
34
112
114

SENSOR MOUNT FOR SUMP DRAINING APPARATUS

BACKGROUND OF THE INVENTION

The present invention relates generally to a sump draining apparatus, particularly to a mount for a liquid level sensor in the sump draining apparatus, and specifically to a receptacle shaped mount for such a pressure transducer in the sump draining apparatus wherein the receptacle shaped mount and pressure transducer are slideable in the axial direction in and out of a distal end of the sump draining apparatus.

U.S. Pat. No. 4,992,030 (issued Feb. 12, 1991) and U.S. Pat. No. 4,966,534 (issued Oct. 30, 1990) relate to sump draining apparatus having a pressure transducer directly set in a distal closed end of an elongate cylindrical housing. Two problems for improvement have been identified. First, ready access to the pressure transducer is difficult. To get to the pressure transducer, the proximal end of the housing is removed, so that in turn a pump and motor can be removed, so that yet in turn the pressure transducer can be removed for being serviced or replaced. Second, the pressure transducer is directly fixed in the distal closed end with screws being tightened against the body of the pressure transducer. The pressure transducer, like many sensors, is relatively delicate and expensive.

SUMMARY OF THE INVENTION

A feature of the present invention is the provision in a sump draining apparatus having first and second end portions of a housing and a pump and motor stacked axially in the sump draining apparatus, of a sensor mounted on a sensor mount drawable axially into and out of an open end of the second end portion of the housing.

Another feature of the present invention is the provision in such a sump draining apparatus, of the mount being receptacle shaped for cradling the sensor therein.

Another feature of the present invention is the provision in such a sump draining apparatus, of a venting and electrical cord for the sensor being releasably engaged at the first end portion of the housing such that the sensor can be safely drawn out of the second end of the housing.

Another feature of the present invention is the provision in such a sump draining apparatus, of the mount instead of the sensor being engaged to a housing of the sump draining apparatus.

Another feature of the present invention is the provision in such a sump draining apparatus, of the sensor being engaged in the mount via a first set of radially oriented pin connectors at a first axial location and via a second set of radially oriented pin connectors at a second axial location.

Another feature of the present invention is the provision in such a sump draining apparatus, of the receptacle shaped mount having a hole for the entry of fluid into the receptacle shaped mount and to the sensor.

An advantage of the present invention is accessibility. The pressure transducer is readily accessible for service or replacement. Only set screws and a cord restraint are loosened. Time is saved.

Another advantage of the present invention is sensitivity. Like an infant, a pressure transducer behaves best when cradled. The receptacle shaped mount is engaged by set screws, not the pressure transducer itself. The receptacle shaped mount isolates the pressure transducer from the housing of the sump draining apparatus that may be jarred as the sump draining apparatus is lowered to remote locations.

Another advantage of the present invention is cost. By improving accessibility of the sensor, time is saved and therefore labor and labor costs are saved. By cradling and guarding the sensor, the sensor has a longer operating life. Less replacement is required and replacement costs are saved.

Other and further features and advantages of the present invention will become apparent to those skilled in the art upon a review of the accompanying specification and drawings.

IN THE DRAWINGS

DESCRIPTION OF THE PREFERRED EMBODIMENT

Figure 1:
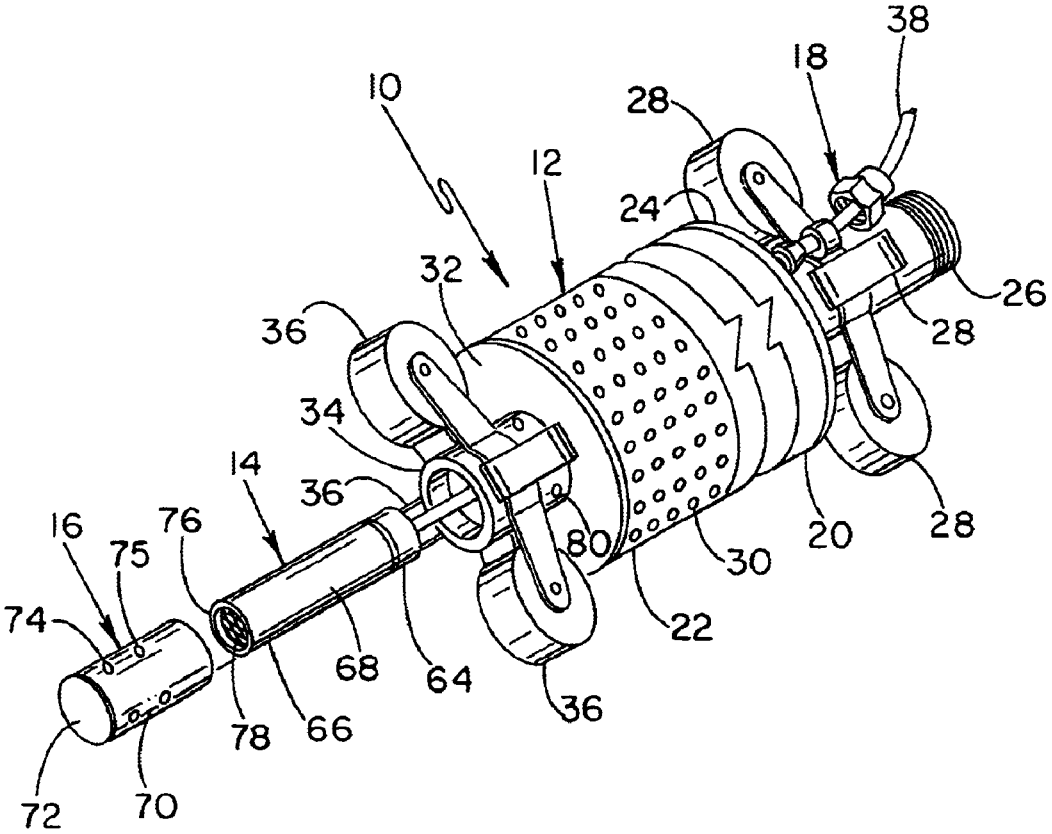
FIG. 1 is perspective view of the present sump draining apparatus and particularly shows a cord restraint at a first end portion of a housing and a sensor and a receptacle shaped sensor mount at a second end portion of the housing.

In accordance with the preferred embodiment of the present invention, the present sump draining apparatus shown in FIGS. 1–5 is generally indicated by reference numeral 10. The present sump draining apparatus 10 is an improvement on the sump draining apparatus shown and described in U.S. Pat. No. 4,992,030 (issued Feb. 12, 1991) and U.S. Pat. No. 4,966,534 (issued Oct. 30, 1990), each of which is hereby incorporated by reference in its entirety.

As shown in FIG. 1, sump draining apparatus 10 includes a housing 12, a sensor 14, a sensor mount 16 that is receptacle shaped, and a cord restraint mechanism 18. More particularly, housing 12 is generally cylindrical and includes a first or proximal end portion 20 and a second or distal end portion 22. First end portion 20 includes a removable end cap 24 and a threaded conduit outlet 26. A set of four wheels 28 is mounted to the conduit outlet 26 at 90 degrees relative to each other, with the wheel axis running normal to an axis of the housing 12 such that housing 12 may be wheeled in the direction of the housing axis. It should be noted that a set of five wheels at 72 degrees relative to each other may be used or a set of six wheels at 60 degrees relative to each other may be used so as to maximize the ease of rolling housing 12 during any spinning of housing 12 along its lengthwise axis as housing 12 is lowered into remote areas in environments such as landfills.

The distal or second end portion 22 of housing 12 includes apertures 30 to permit entry of fluid into housing 12, an annular end plate 32 opposing the end cap 24, and a collar 34 fixed to the end plate 32. A set of four wheels 36 at 90 degrees relative to each other (or a set of five or six wheels) are mounted to the collar 34, with the wheel axis running normal to an axis of the housing 12 such that housing 12 may be wheeled in the direction of the housing axis and such that each of the wheels 36 is aligned with one of the wheels 28 mounted to the first end portion 20 of the housing 12.

Sensor 14 is engaged to an electrical lead or cord 38. Cord 38 runs from sensor 14, through an inside of housing 12, through end cap 24, through cord restraint mechanism 18, and out of the housing 12.

As shown in FIGS. 1, 2A, 2B, 2C and 5, cord restraint mechanism 18 includes a base connector 40 for engagement with a threaded through opening 41 formed in end cap 24. Base connector 40 includes a set of first threads 42 for engaging end cap 24, a fixed head portion 44 for being engaged by a wrench, a set of second threads 46, a plastic tapered pinching cap 48 for pinching the cord 38, and a through opening 50 for the cord 38. Cord restraint mechanism 18 further includes a plastic annular pincher 52 having a through opening 54 for the cord 38. Cord restraint mechanism 18 further includes a threaded nut 56 engagable with the second set of threads 46 of base connector 40. Nut 56 includes a ceiling 58 to bring pressure to bear on pincher 52. Threaded nut 56 further includes a plastic annular cap 60 to support and seal cord 38 relative to nut 56. Nut 56 further includes a through opening 62 for the cord 38. A tightening of nut 56 draws the pincher 52 against the tapered pinching cap 50, which is compressed and drawn against a diametrical portion of cord 38 so as to engage the cord 38 at said location. It should be noted that the desired pinching pressure is sufficiently tight so that a hand pull on cord 38 is insufficient to slide the cord 38 relative to the cord restraint mechanism 18. It should be noted that the desired pinching pressure is sufficiently loose so that a tube or vent or other hollow axial portion set in cord 38 remain at least somewhat hollow such that entrapped air may be conveyed axially through such hollow portions of cord 38 for venting to the atmosphere. Such tube or vent or other axially traveling hollow portion permits the escape of air from housing 12 as leachate or some other fluid rises in a vertically disposed housing 12. It should be noted that the desired pinching pressure is further sufficiently loose to retain the integrity of electrical conductors fixed in cord 38 and so that such electrical conductors are not cut.

As shown in FIGS. 1, 3, 4 and 5, sensor 14 is generally cylindrical in shape and includes a proximal or head or first end portion 64 that engages cord 38 and a sensing or second end portion 66. Portion 64 and portion 66 may be removable relative to each other in a sealing fluid tight engagement where fluid may not pass into sensor 14 through the connection between portions 64 and 66 and where fluid flow from portion 66 to 64 is controlled. Portion 66 may include pressure transducers or other electrically sensitive equipment that may or may not be prone to breaking down over time and that may need replacement, whereupon portion 66 may be removed from portion 64 and replaced with an operating portion 66. Sensor 14, and each of portions 64 and 66, includes a cylindrical sidewall 68.

Sensor 14 is cradled in and fits relatively snugly in sensor mount 16. If desired, such fit may be a relatively tight friction fit. Sensor mount 16 is receptacle shaped so as to include a cylindrical sidewall 70 and a bottom or cap 72 fixed rigidly to and integrally with the sidewall 70. Sidewall 70 includes one or more apertures 74, 75 for the entry of fluid to sensing end 66 or, as noted below, for the reception of set screws.

To maximize engagement between sensor 14 and sensor 16, apertures 74, 75, which are threaded, receive set screws such as set screws 82. The inner ends of such set screws engage sensor 14 to hold the sensor 14 in the sensor mount 16. The total number of apertures 74 for a first set of set screws may amount to three, spaced equidistant from each other about the sensor mount 16. The total number of apertures 75 for a second set of set screws may also amount to three, spaced equidistant from each other. With such a configuration where a multiple number of set screws (such as six) engage sensor 14, sensor 14 is engaged such that each of the set screws brings to bear a minimum amount of pressure upon the sensor 14, which may be relatively delicate and sensitive. Further with such a configuration where the set screws bring pressure to bear upon two different axial locations of the sensor 14, sensor 14 is engaged in a stable manner and is less likely to pivot within sensor mount 16; in other words, sidewall 70 of sensor mount 16 remains parallel to sidewall 68 of sensor 14 when pressure is brought to bear radially around the sensor 14 at two different axial locations. Pin connectors such as set screws 82 are preferred to permit a snug but sliding relationship between sensor mount 16 and collar 34.

As noted above, where apertures 74, 75 are not utilized for set screws, fluid may flow through apertures 74, 75 to sensing end 66. Fluid also may flow to sensing end 66 through any relatively narrow space existing between sidewall 68 of sensor 14 and sidewall 70 of sensor mount 16. Sensor mount 16 has an inner diametrical size equal to or slightly greater than an outer diametrical size of sensor 14 such that lateral movement of sensor 14 is minimized while permitting sensor 14 to slide axially into and out of sensor mount 16. Sensor 14 includes an annular absolute end 76 that is spaced from an inset perforated guard plate 78. Annular absolute end 76 may or may not rest upon an inner surface of sensor mount bottom 72 and absolute end 76 may or may not be undulating to permit fluid to enter through guard plate 78. Further, cap 72 may be removable to permit fluid to directly access perforated guard plate 78. Still further, it should be noted that some sensors 14 do not require direct contact with fluid or pressure or any other condition for operation. It should be further noted that such fluid to be sensed may be any kind of liquid such as water or leachate or any type of gas such as air or methane while the fluid to be pumped by sump draining apparatus 10 is preferably a liquid fluid.

Figure 4:
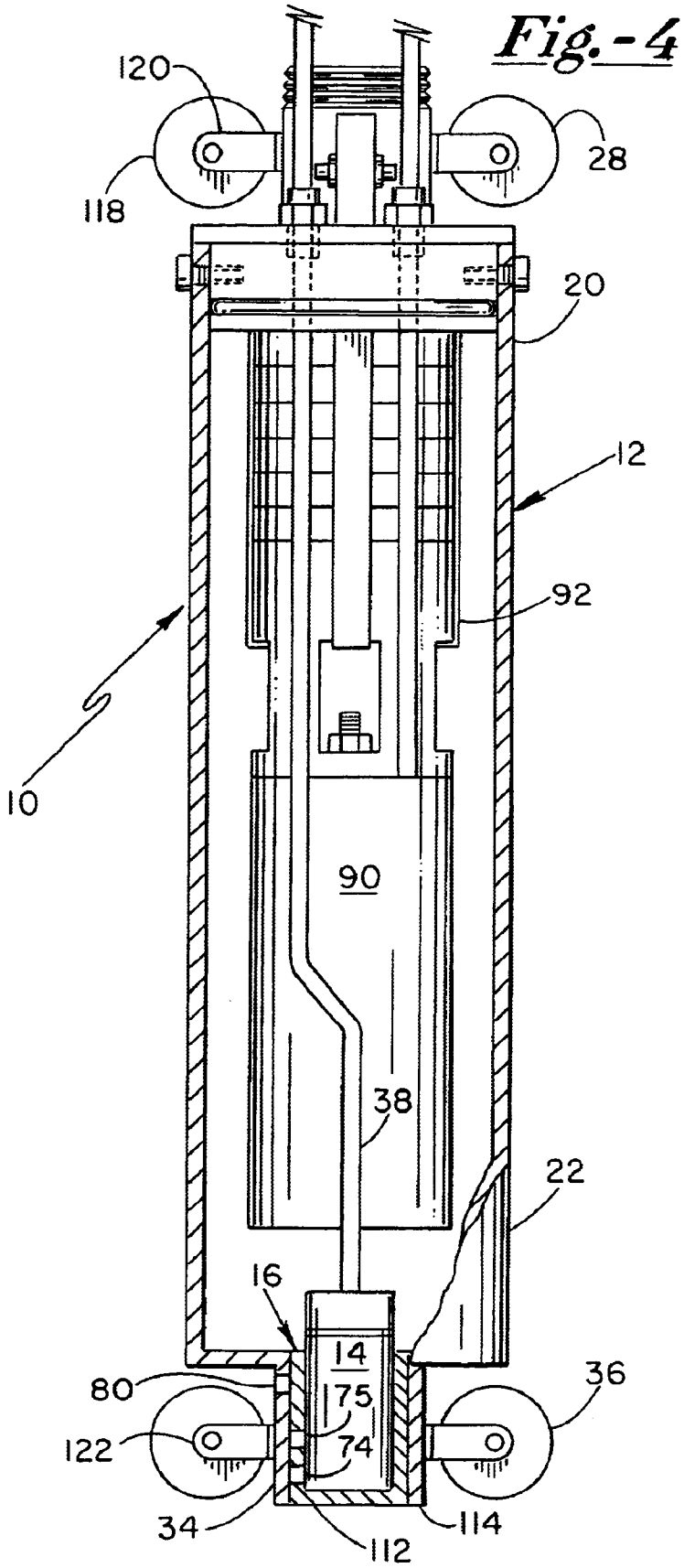
FIG. 4 is a section view of the sump draining apparatus of FIG. 1 and particularly shows the pump and motor set in the housing, the end cap on a first end portion of the housing, and the sensor and sensor mount set in the second end portion of the housing.
Figure 5:
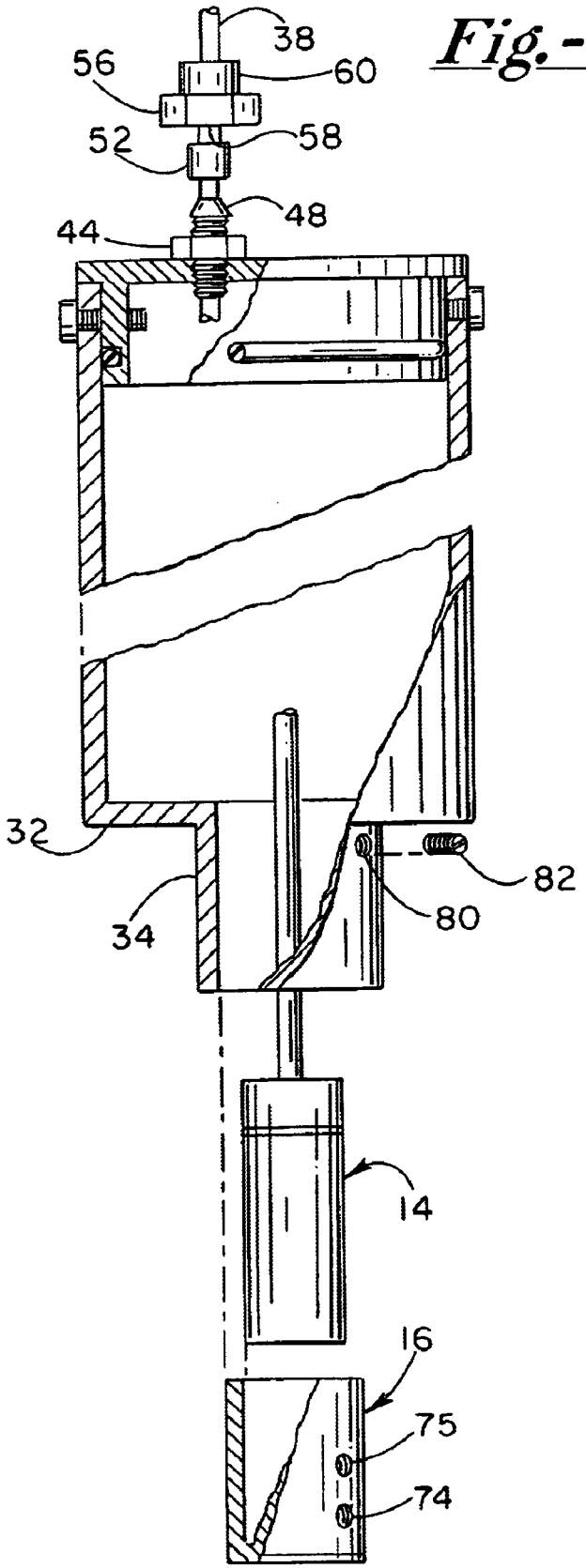
FIG. 5 is a section, partially broken apart view of the sump draining apparatus of FIG. 1 and particularly shows a cord restraint and an axial sliding of the sensor mount and sensor into and out of the housing.

Collar 34 is open ended and is in communication with an opening formed in plate 32. Collar 34 includes a set of three set screw openings 80 for cooperating with respective set screws 82. The three set screw openings 80 are spaced equally about the diameter of collar 34. As shown in FIG. 4, collar 34 is generally of the same axial length as sensor mount 16 such that a set screw 82 engaged in opening 80 engages a portion of sidewall 70 of sensor mount 16. It is preferred that sidewall 70 has no perforations aligned with opening 82 such that set screw 82 does not bring pressure to bear upon the sensor 14 itself. It should be noted that another set of set screw openings may be formed in collar 34 at a different axial location on collar 34 for an additional set of set screws to bring radial pressure to bear upon sensor mount 16.

Figure 2A:
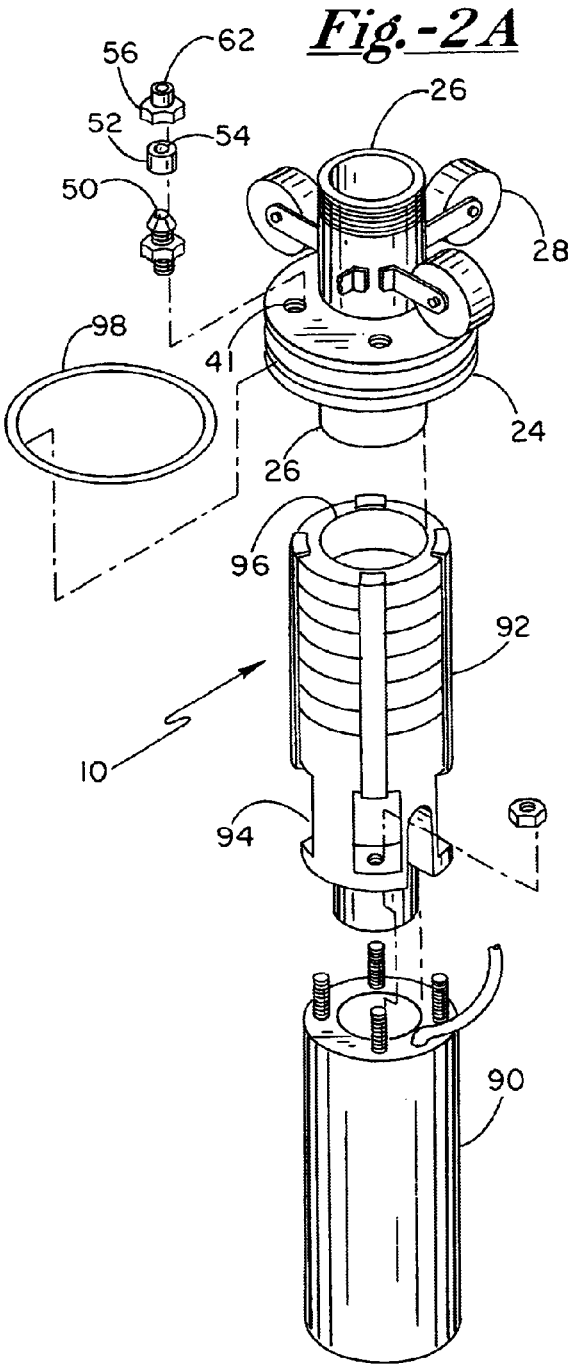
FIG. 2A is a perspective, partially broken apart view of the sump draining apparatus of FIG. 1 and particularly shows the pump, motor and end cap broken apart from each other.
Figure 2B:
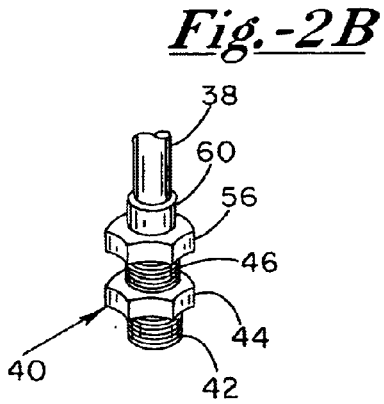
FIG. 2B is a detail perspective view of a cord restraint mechanism of the sump draining apparatus of FIG. 1 where the cord restraint mechanism is in an engaged form.
Figure 2C:
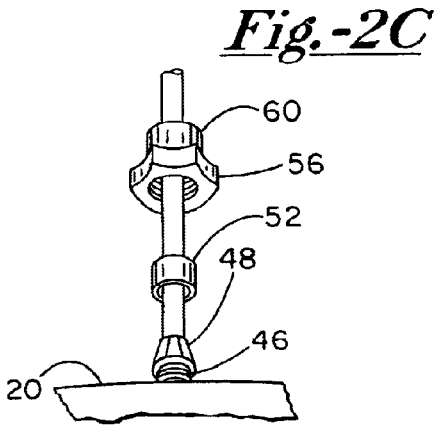
FIG. 2C is a detail perspective view of a cord restraint mechanism of the sump draining apparatus of FIG. 1 where the cord restraint mechanism is in a partially engaged form.

As shown in FIG. 2A, the sump draining apparatus 10 includes a motor 90 and a pump 92, each of which is formed in a generally cylindrical shape. As to motor 90 and pump 92 as a whole and as to the structure and operation of motor 90 and pump 92, U.S. Pat. No. 4,992,030 (issued Feb. 12, 1991) and U.S. Pat. No. 4,966,534 (issued Oct. 30, 1990) are hereby incorporated by reference in their entireties. Motor 90 and pump 92 can operate under liquid in a submerged condition. Pump 92 is operated by motor 90, includes side inlets 94 and an axial outlet 96 in communication with conduit 26.

As shown in FIG. 2A, motor 90 and pump 92 may be bolted together. As further shown in FIG. 2A, end cap 24 engages an O-ring 98 for sealing engagement with an inner surface of cylindrical housing 12.

Figure 3:
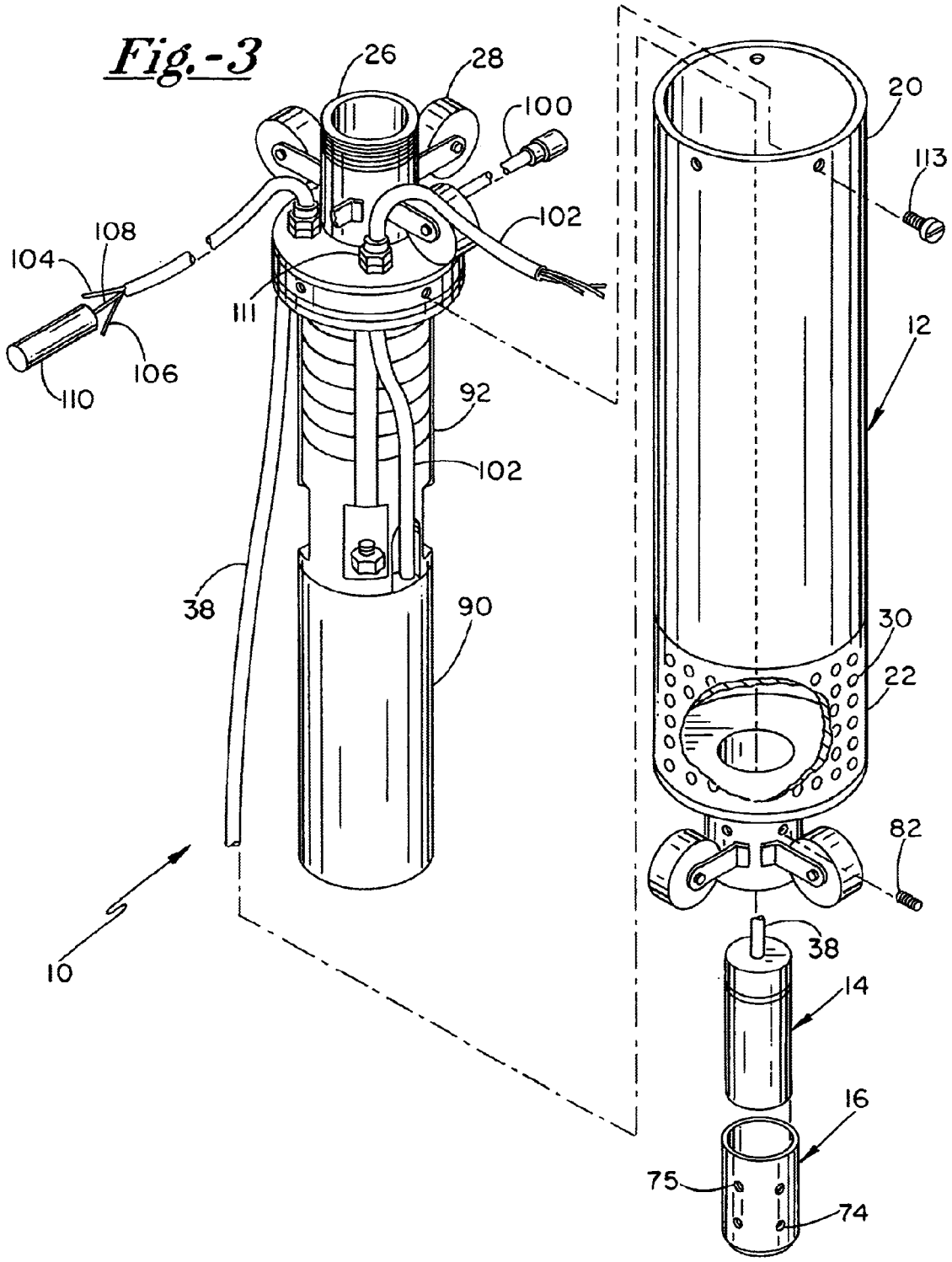
FIG. 3 is a perspective of the sump draining apparatus of FIG. 1 and particularly shows the pump, motor and end cap in fixed relation to each other and ready for insertion into the cylindrical housing.

As shown in FIGS. 3 and 4, cord 38 extends through housing 12 along an inner cylindrical surface of housing 12 and along an outside cylindrical surface of motor 90 and pump 92. Fluid such as leachate may too be disposed in the regions or spaces inside housing 12 and outside motor 90 and pump 92. Cord 38 then travels through end cap 34, through cord restraint mechanism 38, along conduit 26, further along an additional conduit or hose engaged to conduit 26 and finally to a control unit. From the control unit, signals may be sent back down cord 38 or through other leads such as leads 100 or 102, which like cord 38 travel from a control unit, along said additional conduit or hose, along conduit 26, through end cap 34, to the inside of housing 12 and finally to one or more of the motor 90, pump 92 and sensor 14. It should be noted that elements 38, 100 and 102 may be electrical conductors or vent tubes or combinations of both. For example, cord or leadwire 38 may include a first conductor 104, a second conductor 106, and a vent tube 108 for venting fluid such as air or other gas from the area of the collar 34, sensor 14, and sensor mount 16. Vent tube 108 is engaged to a dryer 110. Cord 102 includes a cord restraint mechanism 111 and cord 100 also includes a cord restraint mechanism.

As shown in FIG. 3, end cap 24, conduit 26, pump 92 and motor 90 may be fixed as a unit in housing 12 via pin connectors 113 such that said unit depends from the first end portion 20 of housing 12.

As shown in FIG. 4, an outer surface 112 of end or bottom 72 of sensor mount 16 is preferably flush with or tucked slightly within an absolute end 114 of collar 34 such that collar 34 instead of sensor mount 16 acts as a bumper to bear the brunt of accidental collisions with objects as the sump draining apparatus 10 is lowered into a landfill or other environment.

FIG. 4 further shows sump draining apparatus in an operating condition where the first end portion 20 is sealed against fluid leakage, such as leakage by water, leachate, air or other gas. In other words, cap 24 is sealed relative to housing 12 and cord restraint mechanisms for cords 38, 100, 102 are sealed relative to end cap 24 such that fluid flow through end cap 24 is controlled. Second end portion 22 provides for fluid flow into housing 12 such as through apertures 30 (shown in FIGS. 1 and 2A). Further fluid flow into housing 12 may occur through any slight spacing between collar 34 and mount 16. Within housing 12, fluid flow may occur through apertures 74 in sensor mount 16 and through any slight spacing between mount 16 and sensor 14.

FIG. 4 further shows that each of wheels 28 and 36 include a running surface 118 extending beyond an outer diametrical surface of housing 12. Wheels 28 are mounted on conduit 26 via brackets 120. Wheels 36 are mounted on collar 34 via brackets 122. It should further be noted that a straight line running between outermost points of edges of running surfaces 118 of adjacent wheels extends beyond the outer diametrical surface of housing 12 such that housing 12 is spaced from the surface on which the apparatus 10 is rolled.

In operation to install sensor 14, a distal end of cord 38 is fed through cord restraint mechanism 18 and then engaged to head sensor portion 64. Head sensor portion 64 is then engaged to sensing portion 66 to form the whole operating sensor 14. Sensor 14 is then slid in the axial direction into receptacle shaped sensor mount 16, where sensor 14 is engaged by a friction fit and/or with set screws via apertures 74, 75. Sensor 14 and sensor mount 16 are then fed into housing 12. The sensor mount 16 is then engaged to the collar 34 via set screws 82 in openings 80. Motor 90, pump 92 and end cap 24 are then engaged to housing 12. Cord restraint mechanism 38 is then tightened. It should be noted that in some cases it may be desirable to have a relatively secure engagement of the sensor 14 in the collar 34 such that cord 38 may be drawn relatively straight to minimize kinks or bends in cord 38 which may have a vent tube running therein. In such a case where a relatively secure engagement is desired, the sensor 14 may fit tightly under a friction fit in sensor mount 16 or set screws 82 in apertures 74, 75 may engage the sidewall 68 of the sensor 14.

In operation to service or replace sensor 14, cord restraint mechanism 18 is loosened such that cord 38 may slide relative to cord restraint mechanism 18. Then set screws 82 in collar 34 are loosened. Sensor mount 16, with sensor 14 tucked therein, is slid in the axial direction away from motor 90 and out of collar 34 such that a portion of cord 38 is drawn out of collar 34 with sensor 14 and such that a portion of cord 38 slides relative to cord restraint mechanism 18. Sensor mount 16 is then slid in the axial direction off sensor 14 after set screws, if used in apertures 74, 75, are loosened. Then sensor 14 is serviced. Such servicing may be a cleaning of sensor 14, an inspection of sensor 14, a removal of portion 66, a replacement of portion 66, and/or a disengagement and replacement of sensor 14 as a whole from cord 38.

After such servicing, sensor 14 is tucked back into sensor mount 16 and, if used, set screws in apertures 74, 75 are tightened. Then sensor mount 16, with sensor 14 cradled therein, is slid in the axial direction back into the open ended collar 34 and fixed therein with set screws 82 in openings 80. Then cord 38 may be drawn in the axial direction away from end cap 24 so as to straighten or tighten the portion of cord 38 running from sensor 14 so as to minimize kinks or bends in cord 38 and maximize venting therethrough. Then cord 38 is tightened relative to cap 24 via cord restraint mechanism 18. Then sump draining apparatus 10 is again ready for use.

In operation while submerged or partially submerged in leachate or other fluid, fluid may enter sump draining apparatus 10 through apertures 30 or through any space disposed between the outer surface of sidewall 70 of sensor mount 16 and the inside surface of collar 34. Such fluid in the housing 12 or collar 34 may then flow through apertures 74, 75 of sidewall 70 of sensor mount 16 and to perforated guard 78. Such fluid in the housing 12 or collar 34 may also arrive at perforated guard 78 through any space disposed between the inner surface of sidewall 70 of sensor mount 16 and the outside surface of sidewall 68 of sensor 14. When sensor 14 senses a particular condition, a signal is sent through cord 38 to a control unit whereupon a signal may be sent via one or more of cords 100, 102 so as to operate the motor 90 and pump 92.

It should be noted that sensor mount 16 may be formed of a chemically resistant metal or plastic. If metal, such metal may be stainless steel.

It should be noted that housing 12 is of a stainless steel construction and is corrosion resistant, that wheels 28 and 36 include easy glide durable bearings, that seals such as seal 98 may be Teflon® seal rings, that motor 94 may be a Franklin® electric motor, that housing 12 is a sealed unit with liquid flow drawn past motor 94 for cooling motor 94, that liquid may be pumped out such that merely an extremely low level of liquid remains in the environment from which the liquid is being pumped whereby drawdown to the very bottom of apparatus 10 is facilitated, that the cords or leads of apparatus 10 are engaged in a chemically resistant jacket, that the vent valve system of apparatus 10 prevents pump air lock, and that the pump 92 and apparatus 10 as a whole pumps liquid at a flow rate of about 2 to about 1,200 gpm.

Various modifications may be made in the configuration of the arrangement illustrated here without departing from the invention.

What is claimed is:

1. A sump draining apparatus, comprising:

(a) a housing having first and second end portions, with the first end portion being adapted for engagement with a fluid conduit for conveying fluid away from the housing, with the second end portion having an inlet for drawing fluid into the housing, with the second end portion having an opening, with the housing having an axial direction;

(b) a pump in the housing for pumping fluid from the inlet to the fluid conduit and away from the housing;

(c) a motor in the housing and in communication with the pump to drive the pump;

(d) a sensor for sensing a condition and being in communication with the motor whereby the motor may turn on and off in response to a sensed condition; and (e) a sensor mount for the sensor, with the sensor mount engaged with the second end portion of the housing, with the sensor mount and sensor being slidable in the axial direction into and out of the opening in the second end portion of the housing such that the sensor is easily taken in and out of the housing.

2. The sump draining apparatus of claim 1, wherein the mount comprises a sidewall, with the sidewall confronting and minimizing lateral movement of the sensor, with the sidewall being engaged relative to the housing to fix the mount to the housing.

3. The sump draining apparatus of claim 1, and further comprising:

(a) a cord for the sensor, with the cord running from outside the housing to inside the housing to the sensor, with the cord comprising a vent and an electrical lead; and (b) a cord restraint engaged with the first end of the housing, with the cord restraint being releasably engaged with the cord such that a portion of the cord can be loosened relative to the cord restraint for permitting the sensor to be slid into and out of the second end portion of the housing and such that said portion of the cord can be tightened relative to the cord restraint when the sensor mount and sensor are engaged with the second end portion of the housing.

4. The sump apparatus of claim 1, wherein the sensor comprises a pressure transducer and wherein the sensor mount includes an opening radially extending from the sensor.

5. The sump apparatus of claim 1, and further comprising a pin connector between the sensor mount and the second end portion of the housing for engaging the sensor mount to the housing.

6. The sump apparatus of claim 5, wherein the sensor mount includes a sidewall confronting the sensor, and wherein a portion of the sidewall of the sensor mount is disposed between the pin connector and the sensor to protect the sensor from the pin connector.

7. The sump apparatus of claim 1, and further comprising a first pin connector between the sensor mount and the sensor for engaging the sensor to the sensor mount.

8. The sump apparatus of claim 7, and further comprising a set of first pin connectors radially engaging the sensor at one axial location and a set of second pin connectors radially engaging the sensor at another axial location.

9. The sump apparatus of claim 1, wherein the second end portion of the housing includes a collar, wherein the collar has a width less than a width of the housing, wherein the collar includes said opening, and wherein said collar receives said sensor mount and sensor.

10. The sump draining apparatus of claim 1, wherein each of the housing, pump and motor has a generally cylindrical shape, and wherein the pump and motor are stacked axially in the housing.

11. A sump draining apparatus, comprising:

(a) a housing having first and second end portions, with the first end portion being adapted for engagement with a fluid conduit for conveying fluid away from the housing, with the second end portion having an inlet for drawing fluid into the housing, with the second end portion having an opening, with the housing having an axial direction;

(b) a pump in the housing for pumping fluid from the inlet to the fluid conduit and away from the housing;

(c) a motor in the housing and in communication with the pump to drive the pump;

(d) a sensor for sensing a condition and being in communication with the motor whereby the motor may turn on and off in response to a sensed condition; and (e) a receptacle for holding the sensor, with the receptacle engagable with the second end portion of the housing, with the receptacle and sensor being slidable in the axial direction into and out of the opening in the second end portion of the housing such that the sensor is easily taken in and out of the housing.

12. The sump draining apparatus of claim 11, wherein the sensor comprises a pressure transducer and wherein the receptacle for the sensor comprises an aperture radially extending from the sensor.

13. The sump drawing apparatus of claim 11, and further comprising:

(a) a cord for the sensor, with the cord running from outside the housing to inside the housing to the sensor, with the cord comprising a vent and an electrical lead; and (b) a cord restraint engaged with the first end of the housing, with the cord restraint being releasably engaged with the cord such that a portion of the cord can be loosened relative to the cord restraint for permitting the sensor to be slid into and out of the second end portion of the housing and such that said portion of the cord can be tightened relative to the cord restraint when the sensor mount and sensor are engaged with the second end portion of the housing.

14. A sump draining apparatus, comprising:

(a) a housing having first and second end portions, with the first end portion being adapted for engagement with a fluid conduit for conveying fluid away from the housing, with the second end portion having an inlet for drawing fluid into the housing, with the second end portion having an opening, with the housing having an axial direction;

(b) a pump in the housing for pumping fluid from the inlet to the fluid conduit and away from the housing;

(c) a motor in the housing and in communication with the pump to drive the pump;

(d) a sensor for sensing a condition and being in communication with the motor whereby the motor may turn on and off in response to a sensed condition, with the sensor comprising a pressure transducer;

(e) a sensor mount for the sensor, with the sensor mount engaged with the second end portion of the housing, with the sensor mount and sensor being slidable in the axial direction into and out of the opening in the second end portion of the housing such that the sensor is easily taken in and out of the housing, with the sensor mount including an aperture radially extending from the sensor;

(f) a cord for the sensor, with the cord running from outside the housing to inside the housing to the sensor, with the cord comprising a vent and an electrical lead;

(g) a cord restraint engaged with the first end of the housing, with the cord restraint being releasably engaged with the cord such that a portion of the cord can be loosened relative to the cord restraint for permitting the sensor to be slid into and out of the second end portion of the housing and such that said portion of the cord can be tightened relative to the cord restraint when the sensor mount and sensor are engaged with the second end portion of the housing;

(h) wherein the second end portion of the housing includes a collar, wherein the collar has a width less than a width of the housing, wherein the collar includes said opening, and wherein said collar receives said sensor mount and sensor; and (i) wherein each of the housing, pump and motor has a generally cylindrical shape, and wherein the pump and motor are stacked axially in the housing.

15. The sump draining apparatus of claim 14 and further comprising a wheel at each of the first and second end portions of the housing whereby the housing may be readily run over a surface.

* * * * *